US008949117B2

(12) United States Patent
Yamanashi

(10) Patent No.: US 8,949,117 B2
(45) Date of Patent: Feb. 3, 2015

(54) ENCODING DEVICE, DECODING DEVICE AND METHODS THEREFOR

(75) Inventor: Tomofumi Yamanashi, Kanagawa (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 332 days.

(21) Appl. No.: 13/501,354

(22) PCT Filed: Oct. 13, 2010

(86) PCT No.: PCT/JP2010/006088
§ 371 (c)(1),
(2), (4) Date: Apr. 11, 2012

(87) PCT Pub. No.: WO2011/045927
PCT Pub. Date: Apr. 21, 2011

(65) Prior Publication Data

US 2012/0203546 A1 Aug. 9, 2012

(30) Foreign Application Priority Data

Oct. 14, 2009 (JP) ..... 2009-237684

(51) Int. Cl.
*G10L 21/00* (2013.01)
*G10L 19/24* (2013.01)

(52) U.S. Cl.
CPC ..... *G10L 19/24* (2013.01)
USPC ..... 704/205; 704/225; 704/230

(58) Field of Classification Search
None
See application file for complete search history.

(56) References Cited

U.S. PATENT DOCUMENTS 5,901,234 A * 5/1999 Sonohara et al. ..... 381/104
7,222,069 B2 * 5/2007 Suzuki et al. ..... 704/201

(Continued)

FOREIGN PATENT DOCUMENTS

| | | |
|---|---|---|
| CN | 101167128 | 4/2008 |
| CN | 101496101 | 7/2009 |
| JP | 2008-519991 | 6/2008 |
| JP | 2009-545775 | 12/2009 |

OTHER PUBLICATIONS

Hiroyuki Ehara et al., "Development of 32kbit/s scalable wide-band speech and audio coding algorithm using high-efficiency code-excited linear prediction and band-selective modified discrete cosine transform coding algorithms", Journal of the Acoustical Society of Japan, vol. 64, No. 4, The Acoustical Society of Japan (ASJ), Apr. 1, 2008, pp. 196-207.

(Continued)

*Primary Examiner* — Richemond Dorvil
*Assistant Examiner* — Thuykhanh Le
(74) *Attorney, Agent, or Firm* — Greenblum & Bernstein, P.L.C.

(57) ABSTRACT

Disclosed is an encoding device, wherein the energy information of a given layer is efficiently encoded using a scalable encoding method in which the band to be encoded is selected in each layer, and the quality of decoded signals can be enhanced. An encoding device (101) is equipped with: a second layer encoding unit (205) which generates a second layer encoded information included in which is the first band information of said band; a second layer decoding unit (206) which generates a first decoding signal by using the second layer encoded information; an adding unit (207) which generates a second input signal by using the first decoding signal; and a third layer encoding unit (208) which generates a third layer encoded information included in which is a second band information obtained by selecting a second band to be quantized in the second input signal, and a corrected gain (energy information).

14 Claims, 8 Drawing Sheets

(56) References Cited

U.S. PATENT DOCUMENTS

| | | | | |
|---|---|---|---|---|
| 7,835,904 | B2 * | 11/2010 | Li et al. | 704/200.1 |
| 2005/0010404 | A1 * | 1/2005 | Son et al. | 704/219 |
| 2007/0299669 | A1 * | 12/2007 | Ehara | 704/262 |
| 2008/0027718 | A1 | 1/2008 | Krishnan et al. | |
| 2008/0126082 | A1 * | 5/2008 | Ehara et al. | 704/205 |
| 2009/0070118 | A1 | 3/2009 | Den Brinker et al. | |
| 2009/0094024 | A1 * | 4/2009 | Yamanashi et al. | 704/219 |
| 2011/0004466 | A1 * | 1/2011 | Morii | 704/201 |

OTHER PUBLICATIONS

Akio Jin et al., "Scalable Audio Coding Based on Hierarchical Transform Coding Modules", Transaction of Institute of Electronics and Communication Engineers of Japan, A, vol. J83-A, No. 3, Mar. 2000, pp. 241-252, with partial English translation.

U.S. Appl. No. 13/501,389 to Tomofumi Yamanashi et al., filed Apr. 11, 2012.

U.S. Appl. No. 13/505,634 to Tomofumi Yamanashi et al., filed May 2, 2012.

* cited by examiner

ENCODING DEVICE, DECODING DEVICE AND METHODS THEREFOR

TECHNICAL FIELD

The present invention relates to a coding apparatus, a decoding apparatus, and method thereof, which are used in a communication system that encodes and transmits a signal.

BACKGROUND ART

When a speech/audio signal is transmitted in a packet communication system typified by Internet communication, a mobile communication system, or the like, compression/encoding technology is often used in order to increase speech/audio signal transmission efficiency. Also, recently, there is a growing need for technologies of simply encoding speech/audio signals at a low bit rate and encoding speech/audio signals of a wider band.

Various technologies of integrating plural coding technologies in a hierarchical manner have been developed for the needs. For example, Non-Patent Literature 1 discloses a technique of encoding a spectrum (MDCT (Modified Discrete Cosine Transform) coefficient) of a desired frequency band in the hierarchical manner using TwinVQ (Transform Domain Weighted Interleave Vector Quantization) in which a basic constituting unit is modularized. Simple scalable coding having a high degree of freedom can be implemented by common use of the module plural times. In the technique, a sub-band that becomes a coding target of each hierarchy (layer) is basically a predetermined configuration. At the same time, there is also disclosed a configuration in which a position of the sub-band that becomes the coding target of each hierarchy (layer) is varied in a predetermined band according to a characteristic of an input signal.

CITATION LIST

Non-Patent Literature

NPTL 1

Akio Kami et al., "Scalable Audio Coding Based on Hierarchical Transform Coding Modules", Transaction of Institute of Electronics and Communication Engineers of Japan, A, Vol. J83-A, No. 3, pp. 241-252, March, 2000

SUMMARY OF INVENTION

Technical Problem

However, in Non-Patent Literature 1, in the case that the sub-band that becomes the coding target is selected from plural candidates in each hierarchy (layer), the coding is performed without considering whether the selected sub-band is already encoded in a lower layer. Accordingly, for example, when the vector quantization is performed on energy information on the sub-band that is already selected in the lower layer, the vector quantization is performed irrespective of magnitude of residual energy of each sub-band, which results in a problem in that high coding performance cannot be obtained.

The object of the present invention is to provide a coding apparatus, a decoding apparatus, and method thereof being able to efficiently encode the energy information on the current layer to improve the quality of the decoded signal in the scalable coding scheme in which the band of the coding target is selected in each hierarchy (layer).

Solution to Problem

A coding apparatus of the present invention that includes at least two coding layers includes: a first layer coding section that inputs a first input signal of a frequency domain thereto, selects a first quantization target band of the first input signal from a plurality of sub-bands into which the frequency domain is divided, encodes the first input signal of the first quantization target band to generate first coded information including first band information on the first quantization target band, generates a first decoded signal using the first coded information, and generates a second input signal using the first input signal and the first decoded signal; and a second layer coding section that inputs the second input signal and the first coded information thereto, obtains second band information by selecting second quantization target band of the second input signal from the plurality of sub-bands, obtains a gain of the second input signal of the second quantization target band, encodes the second input signal of the second quantization target band using the first coded information, and generates second coded information including the second band information and gain coded information obtained by coding the gain.

A decoding apparatus of the present invention that receives and decodes information generated by a coding apparatus including at least two coding layers includes: a receiving section that receives the information including first coded information and second coded information, the first coded information being obtained by coding a first layer of the coding apparatus, the first coded information including first band information generated by selecting a first quantization target band of the first layer from a plurality of sub-bands into which a frequency domain is divided, the second coded information being obtained by coding a second layer of the coding apparatus using the first coded information, the second coded information including second band information generated by selecting a second quantization target band of the second layer from the plurality of sub-bands; a first layer decoding section that inputs the first coded information obtained from the information thereto, and generates a first decoded signal with respect to the first coding quantization band set based on the first band information included in the first coded information; and a second layer decoding section that inputs the first coded information and the second coded information, which are obtained from the information, thereto, and generates a second decoded signal by correcting a signal for the second quantization target band, which is set based on the second band information included in the second coded information, using the first coded information and the second coded information.

A coding method of the present invention for performing coding in at least two layers includes: a first layer coding step of inputting a first input signal of a frequency domain thereto, selecting a first quantization target band of the first input signal from a plurality of sub-bands into which the frequency domain is divided, encoding the first input signal of the first quantization target band to generate first coded information including first band information on the first quantization target band, generating a first decoded signal using the first coded information, and generating a second input signal using the first input signal and the first decoded signal; and a second layer coding step of inputting the second input signal and the first coded information thereto, obtaining second band information by selecting second quantization target band of the second input signal from the plurality of sub-bands, obtaining a gain of the second input signal of the second quantization target band, encoding the second input signal of the second quantization target band using the first coded information, and generating second coded information including the second band information and gain coded information obtained by coding the gain.

A decoding method of the present invention for receiving and decoding information generated by a coding apparatus including at least two coding layers includes: a receiving step of receiving the information including first coded information and second coded information, the first coded information being obtained by coding a first layer of the coding apparatus, the first coded information including first band information generated by selecting a first quantization target band of the first layer from a plurality of sub-bands into which a frequency domain is divided, the second coded information being obtained by coding a second layer of the coding apparatus using the first coded information, the second coded information including second band information generated by selecting a second quantization target band of the second layer from the plurality of sub-bands; a first layer decoding step of inputting the first coded information obtained from the information thereto, and generating a first decoded signal with respect to the first quantization target band set based on the first band information included in the first coded information; and a second layer decoding step of inputting the first coded information and the second coded information, which are obtained from the information, thereto, and generating a second decoded signal by correcting a signal for the second quantization target band, which is set based on the second band information included in the second coded information, using the first coded information and the second coded information.

Advantageous Effects of Invention

According to the invention, in the hierarchy coding scheme (scalable coding) in which the band of the coding target is selected in each hierarchy (layer), the energy information can efficiently be encoded by switching the method of encoding the energy information on the quantization target band of the current layer based on the coding result (quantized band) of the lower layer, and therefore the quality of the decoded signal can be improved.

DESCRIPTION OF EMBODIMENTS

Figure 1:
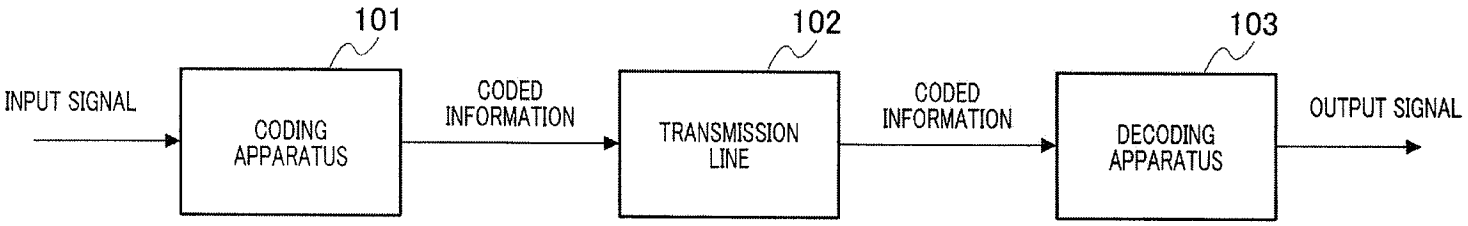
FIG. 1 is a block diagram illustrating a configuration of a communication system including a coding apparatus and a decoding apparatus according to Embodiment of the invention.

Referring to the drawings, one embodiment of the present invention will be described in detail. A speech coding apparatus and a sound decoding apparatus are described as examples of the coding apparatus and decoding apparatus of the invention.

Embodiment

FIG. 1 is a block diagram illustrating a configuration of a communication system including a coding apparatus and a decoding apparatus according to Embodiment of the invention. In FIG. 1, the communication system includes coding apparatus 101 and decoding apparatus 103, and coding apparatus 101 and decoding apparatus 103 can conduct communication with each other through transmission line 102. Herein, coding apparatus 101 and decoding apparatus 103 are usually mounted in a base station apparatus, a communication terminal apparatus, and the like for use.

Coding apparatus 101 divides an input signal into respective N samples (N is a natural number), and performs coding in each frame with the N samples as one frame. At this point, it is assumed that x(n) is the input signal that becomes a coding target. n (n=0, . . . , N−1) expresses an (n+1)th signal element in the input signal that is divided every N samples. Coding apparatus 101 transmits encoded input information (hereinafter referred to as "coded information") to decoding apparatus 103 through transmission line 102.

Decoding apparatus 103 receives the coded information that is transmitted from coding apparatus 101 through transmission line 102, and decodes the coded information to obtain an output signal.

Figure 2:
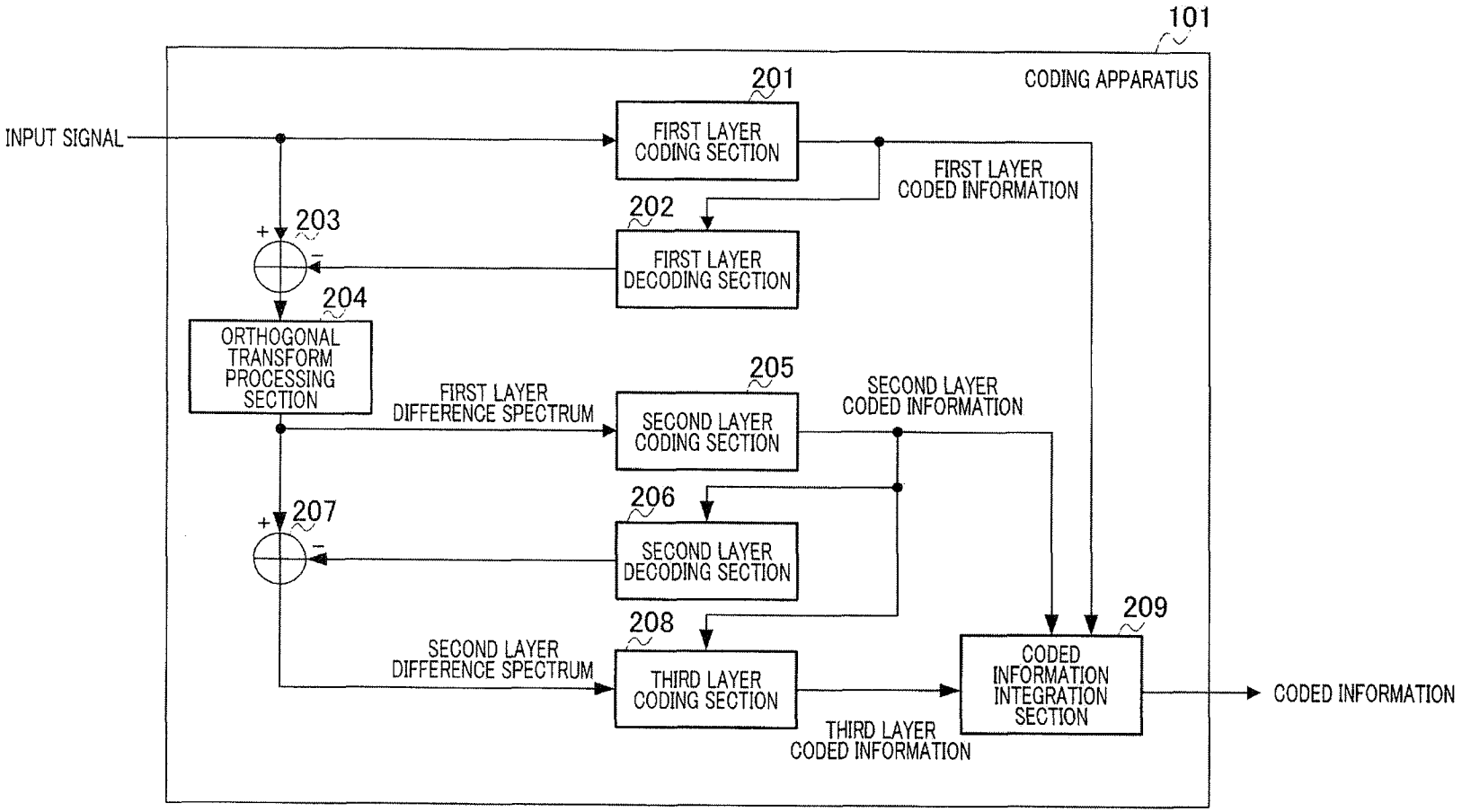
FIG. 2 is a block diagram illustrating a main configuration of the coding apparatus in FIG. 1.

FIG. 2 is a block diagram illustrating a main configuration of coding apparatus 101 in FIG. 1. For example, it is assumed that coding apparatus 101 is a hierarchical coding apparatus including three coding hierarchies (layers). Hereinafter, it is assumed that the three layers are referred to as a first layer, a second layer, and a third layer in the ascending order of a bit rate.

For example, first layer coding section 201 encodes the input signal by a CELP (Code Excited Linear Prediction) speech coding method to generate first layer coded information, and outputs the generated first layer coded information to first layer decoding section 202 and coded information integration section 209.

For example, first layer decoding section 202 decodes the first layer coded information, which is input from first layer coding section 201, by the CELP speech decoding method to generate a first layer decoded signal, and outputs the generated first layer decoded signal to adder 203.

Adder 203 adds the first layer decoded signal to the input signal while inverting a polarity of the first layer decoded signal, thereby calculating a difference signal between the input signal and the first layer decoded signal. Then, adder 203 outputs the obtained difference signal as a first layer difference signal to orthogonal transform processing section 204.

Orthogonal transform processing section 204 includes buffer buf1($n$)(n=0, . . . , N−1) therein, and converts first layer difference signal x1($n$) into a frequency domain parameter (frequency domain signal) by performing an MDCT (Modified Discrete Cosine Transform) to first layer difference signal x1($n$).

An orthogonal transform processing in orthogonal transform processing section 204, namely, an orthogonal transform processing calculating procedure and data output to an internal buffer will be described below.

Orthogonal transform processing section 204 initializes buffer buf1($n$) to an initial value "0" by the following equation (1).

(Equation 1)

$$buf1(n)=0(n=0,\ldots,N-1) \quad [1]$$

Then orthogonal transform processing section 204 performs the Modified Discrete Cosine Transform (MDCT) to the first layer difference signal x1($n$) according to the following equation (2), and obtains an MDCT coefficient (hereinafter referred to as a "first layer difference spectrum") X1($k$) of the first layer difference signal x1($n$).

(Equation 2)

$$X1(k)=\frac{2}{N}\sum_{n=0}^{2N-1} x1'(n)\cos\left[\frac{(2n+1+N)(2k+1)\pi}{4N}\right] \quad [2]$$

$$(k-0,\ldots,N-1)$$

Where k is an index of each sample in one frame. Using the following equation (3), orthogonal transform processing section 204 obtains x1'($n$) that is a vector formed by coupling the first layer difference signal x1($n$) and buffer buf1($n$).

(Equation 3)

$$x1'(n)=\begin{cases} buf1(n) & (n=0,\ldots,N-1) \\ x1(n-N) & (n=N,\ldots,2N-1) \end{cases} \quad [3]$$

Then, orthogonal transform processing section 204 updates buffer buf1($n$) using the following equation (4).

(Equation 4)

$$buf1(n)=x1(n)(n=0,\ldots,N-1) \quad [4]$$

Orthogonal transform processing section 204 outputs the first layer difference spectrum X1($k$) to second layer coding section 205 and adder 207.

Second layer coding section 205 generates second layer coded information using the first layer difference spectrum X1($k$) input from orthogonal transform processing section 204, and outputs the generated second layer coded information to second layer decoding section 206, third layer coding section 208, and coded information integration section 209. The details of second layer coding section 205 will be described later.

Second layer decoding section 206 decodes the second layer coded information input from second layer coding section 205, and calculates a second layer decoded spectrum. Second layer decoding section 206 outputs the generated second layer decoded spectrum to adder 207. The details of second layer decoding section 206 will be described later.

Adder 207 adds the second layer decoded spectrum to the first layer difference spectrum while inverting the polarity of the second layer decoded spectrum, thereby calculating a difference spectrum between the first layer difference spectrum and the second layer decoded spectrum. Then, adder 207 outputs the obtained difference spectrum as a second layer difference spectrum to third layer coding section 208.

Third layer coding section 208 generates third layer coded information using the second layer coded information input from second layer coding section 205 and the second layer difference spectrum input from adder 207, and outputs the generated third layer coded information to coded information integration section 209. The details of third layer coding section 208 will be described later.

Coded information integration section 209 integrates the first layer coded information input from first layer coding section 201, the second layer coded information input from second layer coding section 205, and the third layer coded information input from third layer coding section 208. Then, if necessary, coded information integration section 209 attaches a transmission error code and the like to the integrated information source code, and outputs the result to transmission line 102 as coded information.

Figure 3:
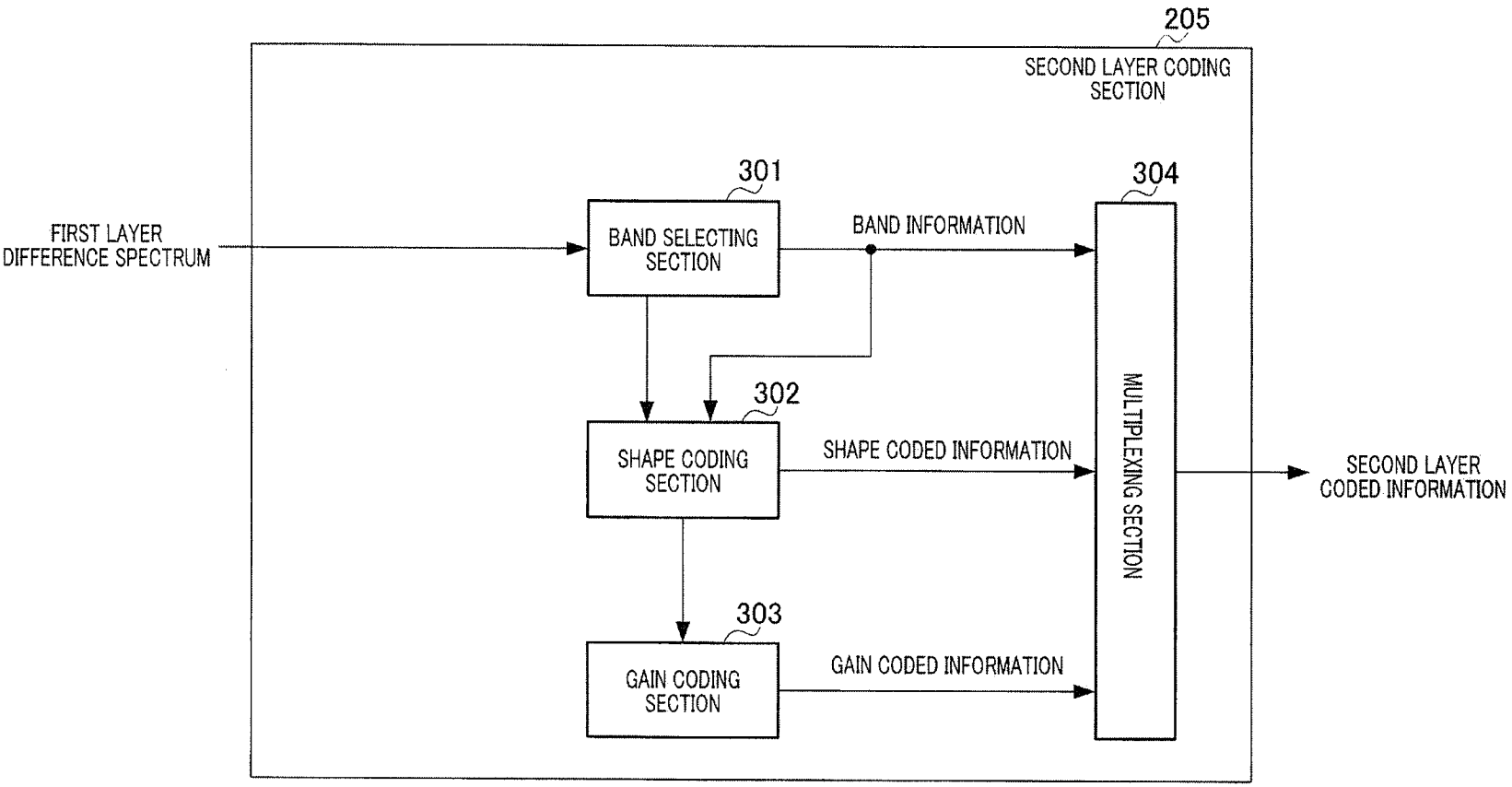
FIG. 3 is a block diagram illustrating a main configuration of a second layer coding section in FIG. 2.

FIG. 3 is a block diagram illustrating a main configuration of second layer coding section 205.

In FIG. 3, second layer coding section 205 includes band selecting section 301, shape coding section 302, gain coding section 303, and multiplexing section 304.

Band selecting section 301 divides the first layer difference spectrum input from orthogonal transform processing section 204 into plural sub-bands, selects a band (quantization target band) that becomes a quantization target from the plural sub-bands, and outputs band information indicating the selected band to shape coding section 302 and multiplexing section 304. Band selecting section 301 outputs the first layer difference spectrum to shape coding section 302. As to the input of the first layer difference spectrum to shape coding section 302, the first layer difference spectrum may directly be input from orthogonal transform processing section 204 to shape coding section 302 irrespective of the input of the first layer difference spectrum from orthogonal transform processing section 204 to band selecting section 301. The details of processing of band selecting section 301 will be described later.

Using the spectrum (MDCT coefficient) corresponding to the band indicated by the band information input from band selecting section 301 in the first layer difference spectrum input from band selecting section 301, shape coding section 302 encodes the shape information to generate shape coded information, and outputs the generated shape coded information to multiplexing section 304. Shape coding section 302 obtains an ideal gain (gain information) that is calculated during the shape coding, and outputs the obtained ideal gain to gain coding section 303. The details of processing of shape coding section 302 will be described later.

The ideal gain is input to gain coding section 303 from shape coding section 302. Gain coding section 303 obtains gain coded information by quantizing the ideal gain input from shape coding section 302. Gain coding section 303 outputs the obtained gain coded information to multiplexing section 304. The details of processing of gain coding section 303 will be described later.

Multiplexing section 304 multiplexes the band information input from band selecting section 301, the shape coded information input from shape coding section 302, and the gain coded information input from gain coding section 303, and outputs an obtained bit stream as the second layer coded information to second layer decoding section 206, third layer coding section 208, and coded information integration section 209.

Second layer coding section 205 having the above configuration is operated as follows.

The first layer difference spectrum X1($k$) is input to band selecting section 301 from orthogonal transform processing section 204.

Band selecting section 301 divides the first layer difference spectrum X1($k$) into the plural sub-bands. The case that the first layer difference spectrum X1($k$) is equally divided into J (J is a natural number) sub-bands is described by way of example. Band selecting section 301 selects consecutive L (L is a natural number) sub-bands in the J sub-bands to obtain M (M is a natural number) kinds of groups of the sub-bands. Hereinafter, the M kinds of groups of the sub-bands are referred to as a region.

Figure 4:
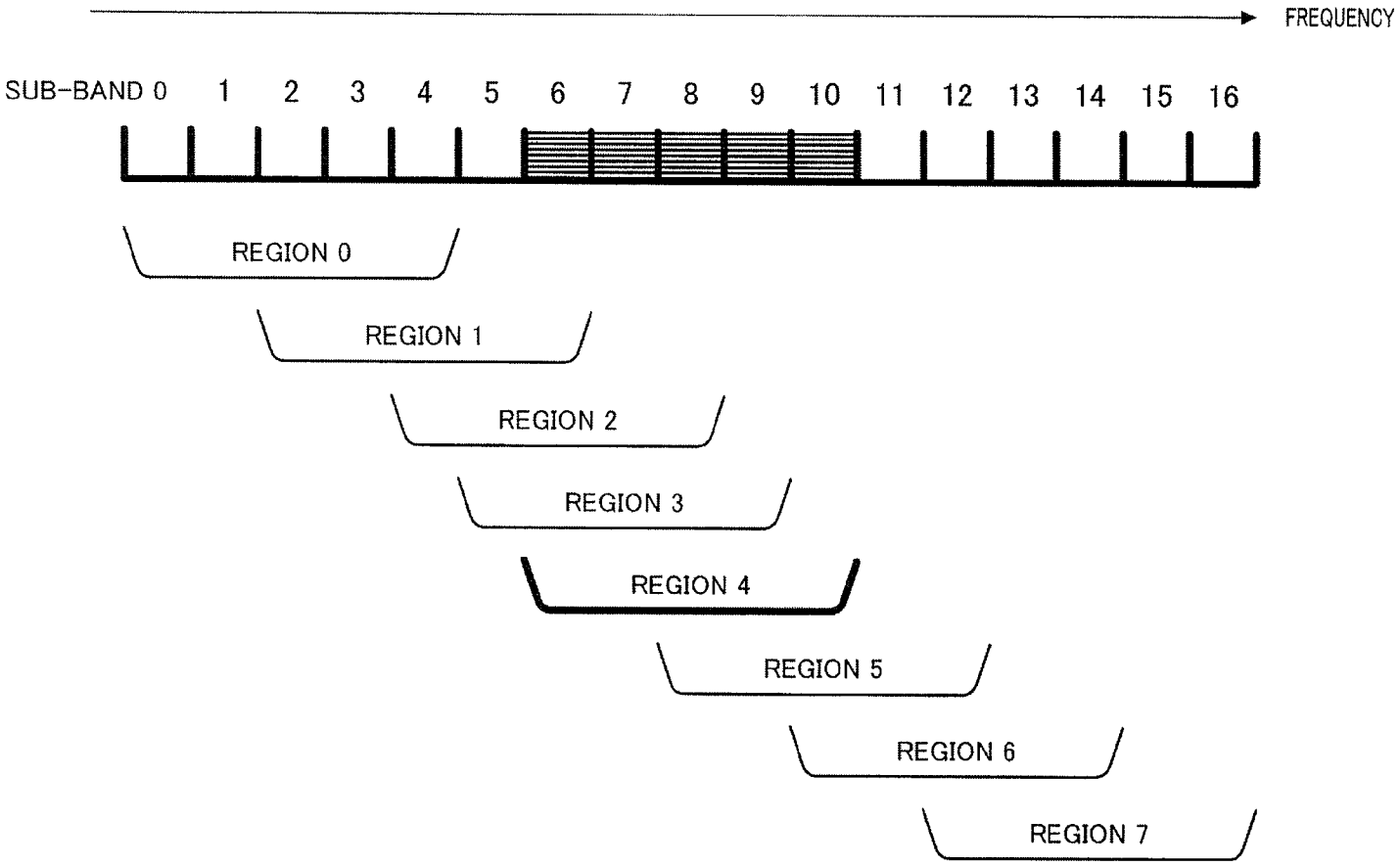
FIG. 4 is a view illustrating a configuration of a region according to Embodiment.

FIG. 4 is a view illustrating a configuration of the region obtained by band selecting section 301.

In FIG. 4, the number of sub-bands is 17 (J=17), the number of kinds of the regions is 8 (M=8), and consecutive 5 (L=5) sub-bands constitute each region. For example, region 4 includes 6 to 10 sub-bands.

Then band selecting section 301 calculates average energy E1($m$) in each of the M kinds of regions according to the following equation (5).

(Equation 5)

$$E1(m) = \frac{\sum_{j=S(m)}^{S(m)+L-1} \sum_{k=B(j)}^{B(j)+W(j)} (X1(k))^2}{L} \quad (m = 0, \ldots, M-1) \tag{5}$$

Where j is an index of each of the J sub-bands and m is an index of each of the M kinds of regions. S(m) indicates a minimum value in indexes of the L sub-bands constituting region m, and B(j) is a minimum value in indexes of the plural MDCT coefficients constituting sub-band j. W(j) indicates a band width of sub-band j. The case that J sub-bands have the equal band width, namely, W(j) is a constant, will be described below by way of example.

Band selecting section 301 selects the region where the average energy E1($m$) is maximized, for example, the band including sub-bands j" to (j"+L−1) as a band (quantization target band) that becomes the quantization target, and band selecting section 301 outputs an index m_max indicating the region as the band information to shape coding section 302 and multiplexing section 304. Band selecting section 301 outputs the first layer difference spectrum X1($k$) of the quantization target band to shape coding section 302. Hereinafter, it is assumed that j" to (j"+L−1) are band indexes indicating the quantization target band selected by band selecting section 301.

Shape coding section 302 performs shape quantization in each sub-band to the first layer difference spectrum X1($k$) corresponding to the band that is indicated by band information m_max input from band selecting section 301. Specifically, shape coding section 302 searches a built-in shape code book including SQ shape code vectors in each of the L sub-bands, and obtains the index of the shape code vector in which an evaluation scale Shape_q(i) of the following equation (6) is maximized.

(Equation 6)

$$\text{Shape_q}(i) = \frac{\left\{\sum_{k=0}^{W(j)} (X1(k+B(j)) \cdot SC_k^i)\right\}^2}{\sum_{k=0}^{W(j)} SC_k^i \cdot SC_k^i} \quad (j = j'', \ldots, j''+L-1, i = 0, \ldots, SQ-1) \tag{6}$$

Where $SC^i_k$ is the shape code vector constituting the shape code book, i is the index of the shape code vector, and k is the index of the element of the shape code vector.

Shape coding section 302 outputs an index S_max of the shape code vector, in which the evaluation scale Shape_q(i) of the equation (6) is maximized, as the shape coded information to multiplexing section 304. Shape coding section 302 calculates an ideal gain Gain_i(j) according to the following equation (7), and outputs the calculated ideal gain Gain_i(j) to gain coding section 303.

(Equation 7)

$$\text{Gain_i}(j) = \frac{\sum_{k=0}^{W(j)} \left(X1(k+B(j)) \cdot SC_k^{S_max}\right)}{\sum_{k=0}^{W(j)} SC_k^S \cdot SC_k^{S_max}} \quad (j = j'', \ldots, j''+L-1) \tag{7}$$

Gain coding section 303 quantizes the ideal gain Gain_i(j) input from the shape coding section 302 according to the following equation (8). At this point, gain coding section 303 deals with the ideal gain as an L-dimensional vector, and searches the built-in gain code book including GQ gain code vectors to perform vector quantization.

(Equation 8)

$$\text{Gain_q}(i) = \left\{\sum_{j=0}^{L-1} \{\text{Gain_i}(j+j'') - GC_j^i\}\right\}^2 \quad (i = 0, \ldots, GQ-1) \tag{8}$$

At this point, the index of the gain code book that minimizes a square error Gain_q(i) of the equation (8) is expressed by G_min.

Gain coding section 303 outputs the index G_min as the gain coded information to multiplexing section 304.

Multiplexing section 304 multiplexes the band information m_max input from band selecting section 301, the shape coded information S_max input from shape coding section 302, and the gain coded information G_min input from gain coding section 303, and outputs the obtained bit stream as the second layer coded information to second layer decoding section 206, third layer coding section 208, and coded information integration section 209.

Figure 5:
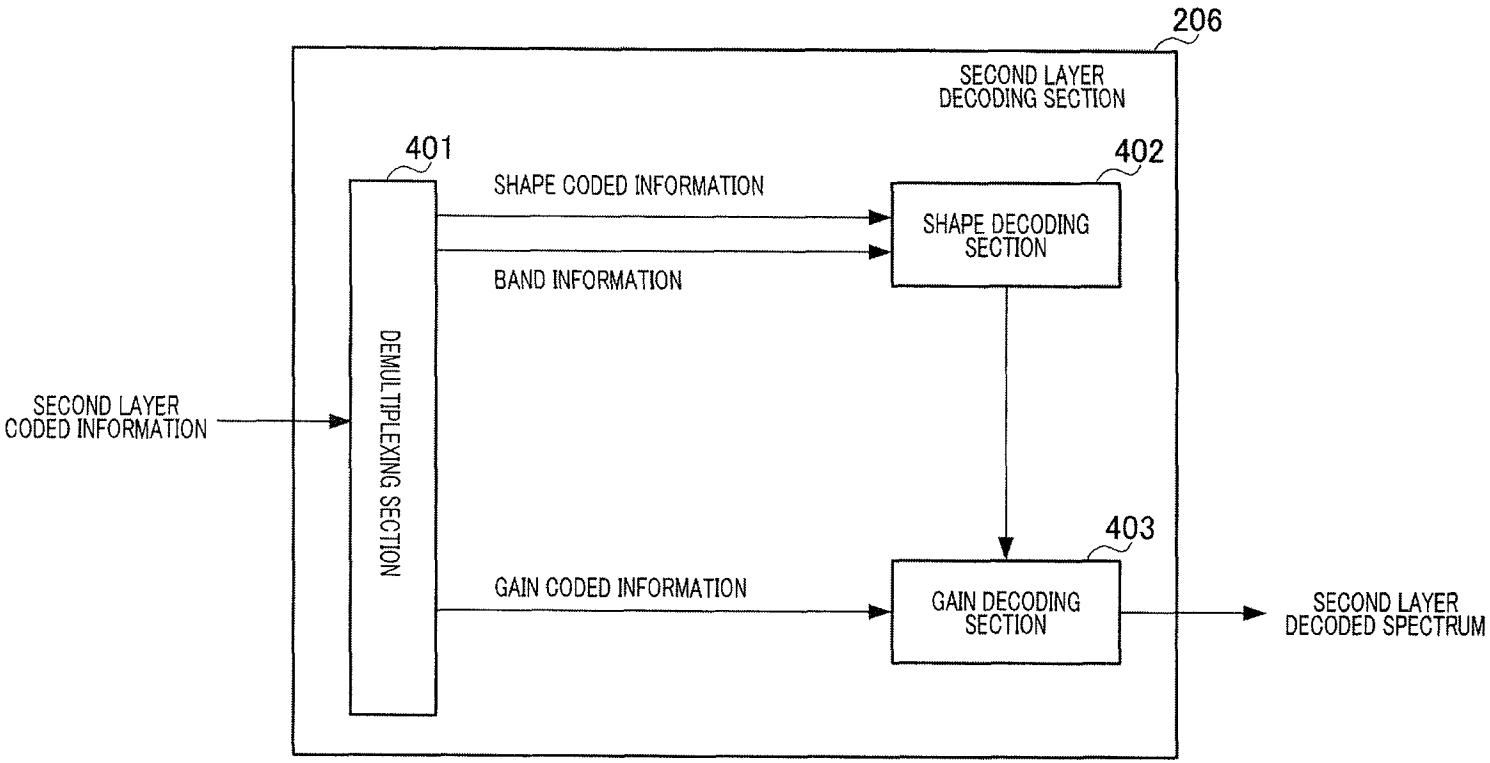
FIG. 5 is a block diagram illustrating a main configuration of a second layer decoding section in FIG. 2.

FIG. 5 is a block diagram illustrating a main configuration of second layer decoding section 206.

In FIG. 5, second layer decoding section 206 includes demultiplexing section 401, shape decoding section 402, and gain decoding section 403.

Demultiplexing section 401 demultiplexes the band information, the shape coded information, and the gain coded information from the second layer coded information input from second layer coding section 205, outputs the obtained band information and shape coded information to shape decoding section 402, and outputs the obtained gain coded information to gain decoding section 403.

Shape decoding section 402 obtains the value of the shape of the MDCT coefficient corresponding to the quantization target band, which is indicated by the band information input from demultiplexing section 401, by decoding the shape coded information input from demultiplexing section 401, and shape decoding section 402 outputs the obtained value of the shape to gain decoding section 403. The details of processing of shape decoding section 402 will be described later.

Gain decoding section 403 obtains the gain value by performing dequantization to the gain coded information input from demultiplexing section 401 using the built-in gain code book. Gain decoding section 403 obtains a decoded MDCT coefficient of the coding target band using the obtained gain value and the value of the shape input from shape decoding section 402, and outputs the obtained decoded MDCT coefficient as the second layer decoded spectrum to adder 207. The details of processing of gain decoding section 403 will be described later.

Second layer decoding section 206 having the above configuration is operated as follows.

Demultiplexing section 401 demultiplexes the band information m_max, the shape coded information S_max, and the gain coded information G_min from the second layer coded information input from second layer coding section 205, outputs the obtained band information m_max and shape coded information S_max to shape decoding section 402, and outputs the obtained gain coded information G_min to gain decoding section 403.

Shape decoding section 402 is provided with the same shape code book as the shape code book included in shape coding section 302 of second layer coding section 205. Shape decoding section 402 searches the shape code vector in which the shape coded information S_max input from demultiplexing section 401 is used as the index. Shape decoding section 402 outputs the searched shape code vector as the value of the shape of the MDCT coefficient of the quantization target band, which is indicated by the band information m_max input from demultiplexing section 401, to gain decoding section 403. At this point, the shape code vector that is searched as the value of the shape is expressed by Shape_q'(k) (k=B(j"), . . . , B(j"+L)−1).

Gain decoding section 403 is provided with the same gain code book as the gain code book included in gain coding section 303 of second layer coding section 205. Gain decoding section 403 performs the dequantization to the gain value according to the following equation (9). Gain decoding section 403 deals with the gain value as the L-dimensional vector to perform the vector dequantization. That is, a gain code vector $GC_j^{G_min}$ corresponding to the gain coded information G_min is directly used as the gain value.

(Equation 9)

$$\text{Gain_}q'(j+j'')=GC_j^{G_min}(j=0,\ldots,L-1) \quad [9]$$

Then gain decoding section 403 calculates the decoded MDCT coefficient as second layer decoded spectrum X2"(k) according to the following equation (10) using the gain value obtained by the dequantization of the current frame and the value of the shape input from shape decoding section 402. In the case that k exists in B(j") to B(j"+1)−1 during the dequantization of the decoded MDCT coefficient, the gain value takes a value of Gain_q'(j").

(Equation 10)

$$X2''(k)=\text{Gain_}q'(j)\cdot\text{Shape_}q'(k) \quad [10]$$
$$\begin{pmatrix} k=B(j''),\ldots,B(j''+L)-1 \\ j=j'',\ldots,j''+L-1 \end{pmatrix}$$

Gain decoding section 403 outputs the calculated second layer decoded spectrum X2"(k) to adder 207 according to the equation (10).

Figure 6:
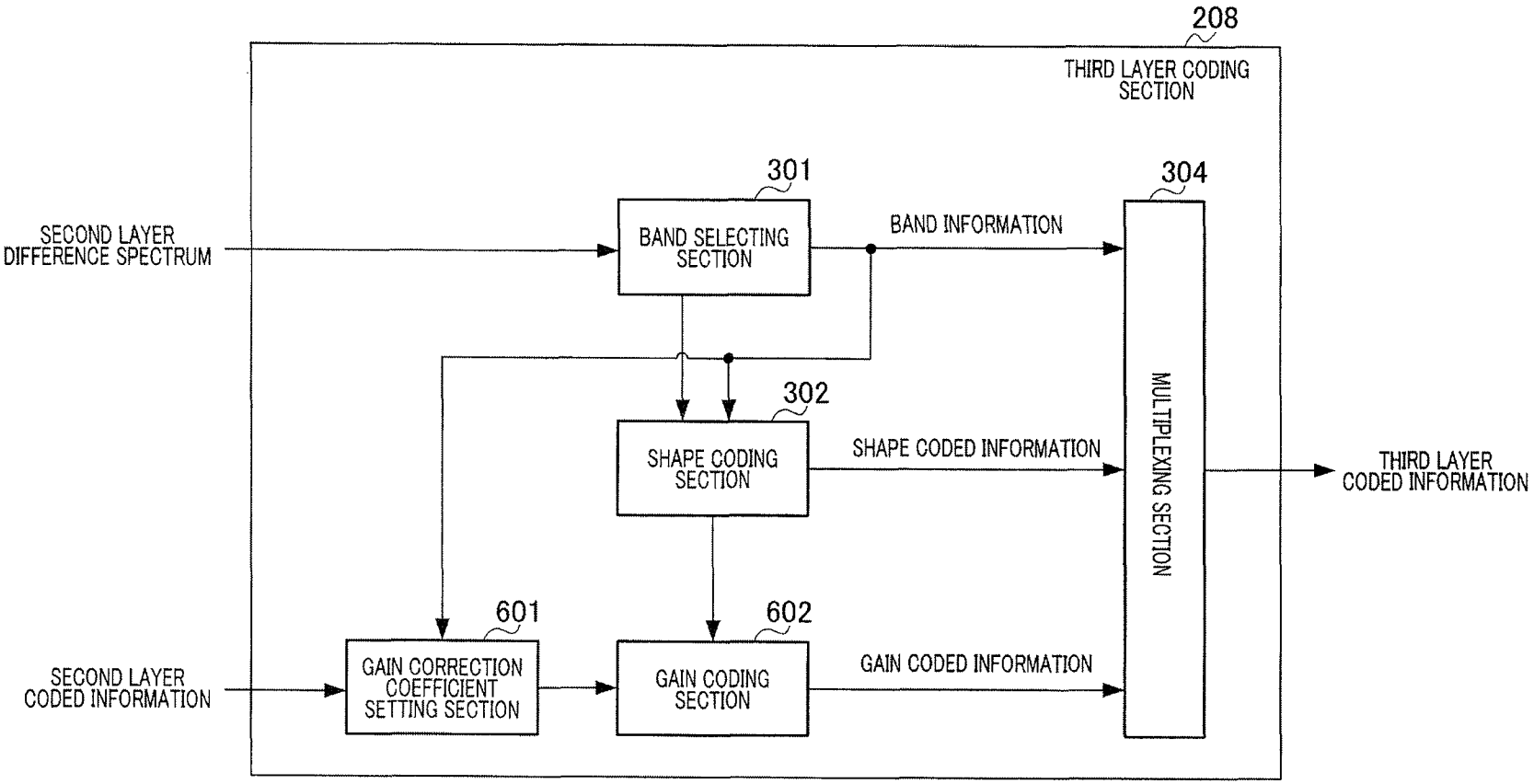
FIG. 6 is a block diagram illustrating a main configuration of a third layer coding section in FIG. 2.

FIG. 6 is a block diagram illustrating a main configuration of third layer coding section 208.

In FIG. 6, third layer coding section 208 includes band selecting section 301, shape coding section 302, gain correction coefficient setting section 601, gain coding section 602, and multiplexing section 304. Since the structural elements of band selecting section 301 and shape coding section 302 are identical to those of second layer coding section 205 except input and output names, the structural elements are designated by the identical numeral, and the description thereof is omitted.

The band information is input to gain correction coefficient setting section 601 from band selecting section 301. The band information is information on the band that is selected as the coding target by third layer coding section 208, and hereinafter the band information is referred to as "third layer band information".

The second layer coded information is input to gain correction coefficient setting section 601 from second layer coding section 205. The second layer coded information includes information on the band that is selected as the coding target by second layer coding section 205. Hereinafter, the information on the band that is selected as the coding target by second layer coding section 205 is referred to as "second layer band information".

Gain correction coefficient setting section 601 sets a correction coefficient that is used to quantize the gain information with respect to the sub-bands indicated by the third layer band information from the second layer band information and the third layer band information.

Specifically, in the case that the sub-band indicated by the second layer band information is not included in the sub-band indicated by the third layer band information (that is, in the case that third layer coding section 208 encodes the band that is not selected as the coding target by second layer coding section 205), a gain correction coefficient $\gamma_j$ is set as expressed by the following equation (11).

(Equation 11)

$$\gamma_j=1.0(j=j'',\ldots,j''+L-1) \quad [11]$$

In the case that the sub-band indicated by the second layer band information is included in the sub-band indicated by the third layer band information (that is, in the case that third layer coding section 208 re-encodes the band that is selected as the coding target by second layer coding section 205), the gain correction coefficient $\gamma_j$ is set as expressed by the following equation (12).

(Equation 12)

$$\gamma_j=0.5(j=j'',\ldots,j''+L-1) \quad [12]$$

Gain correction coefficient setting section 601 outputs the set gain correction coefficient $\gamma_j$ to gain coding section 602.

The ideal gain is input to gain coding section 602 from shape coding section 302. The gain correction coefficient $\gamma_j$ is input to gain coding section 602 from gain correction coefficient setting section 601. Gain coding section 602 corrects the ideal gain by dividing the ideal gain input from shape coding section 302 by the gain correction coefficient $\gamma_j$, as expressed by an equation (13).

(Equation 13)

$$\text{Gain_}i'(j)=\text{Gain_}i(j)/\gamma_j(j=j'', \ldots, j''+L-1) \quad [13]$$

Then, gain coding section 602 obtains gain coded information by quantizing an ideal gain Gain_i'(j) that is corrected using the gain correction coefficient $\gamma_j$ according to the equation (13).

Specifically, using ideal gain Gain_i'(j) that is corrected using the gain correction coefficient $\gamma_j$ according to the equation (13), gain coding section 602 searches the built-in gain code book including the GQ gain code vectors in each of the L sub-bands, and obtains the index of the gain code vector in which a square error Gainq_i(i) of an equation (14) is minimized.

(Equation 14)

$$\text{Gain_q}(i) = \left\{\sum_{j=0}^{L-1} \{\text{Gain_}i'(j+j'') - GC_j^i\}\right\}^2 \quad [14]$$

$$(i = 0, \ldots, GQ-1)$$

Where $GC^i_j$ is the gain code vector constituting the gain code book, i is the index of the gain code vector, and k is the index of the element of the gain code vector. For example, j has values of 0 to 4 in the case that the number of sub-bands constituting the region is 5 (in the case of L=5). Gain coding section 602 deals with the L sub-bands in one region as the L-dimensional vector to perform the vector quantization.

Gain coding section 602 outputs an index G_min of the gain code vector, in which the square error Gainq_i(i) of the equation (14) is minimized, as the gain coded information to multiplexing section 304.

Thus, as expressed by the equation (11) or the equation (12), gain correction coefficient setting section 601 switches the gain correction coefficient $\gamma_j$ used to correct the ideal gain according to the case that the sub-band indicated by the second layer band information in the lower layer is not included in the sub-band indicated by the third layer band information and the case that the sub-band indicated by the second layer band information in the lower layer is included in the sub-band indicated by the third layer band information.

For the coding target band that is quantized in the lower layer upon quantizing the gain information on the coding target band of the current layer, gain coding section 602 searches the gain code vector, which best approximates the ideal gain after the correction, from the gain code book with respect to the corresponding element of the gain code book using the ideal gain that is corrected by the gain correction coefficient $\gamma_j$.

As can be seen from the equation (11) and the equation (12), in Embodiment, in the case that the sub-band indicated by the third layer band information in the current layer includes the sub-band indicated by the second layer band information in the lower layer, the correction is performed such that the ideal gain Gain_i(j) is increased.

That is, it is said that the gain correction coefficient $\gamma_j$ is a coefficient that brings a distribution of magnitude of the gain code vector of the quantization target band in the current layer close to a distribution (a distribution of the magnitude of the gain code vector in the gain code book) of the gain code vector of the quantization target band in the lower layer.

As a result, even if the vector quantization is performed to the plural elements in which energy magnitude differs largely from each other, because the energy magnitude of the elements of the gain code vector can be smoothed, so that the vector quantization can efficiently be performed using the same gain code book.

The processing of third layer coding section 208 has been described above.

The processing of coding apparatus 101 has been described above.

Figure 7:
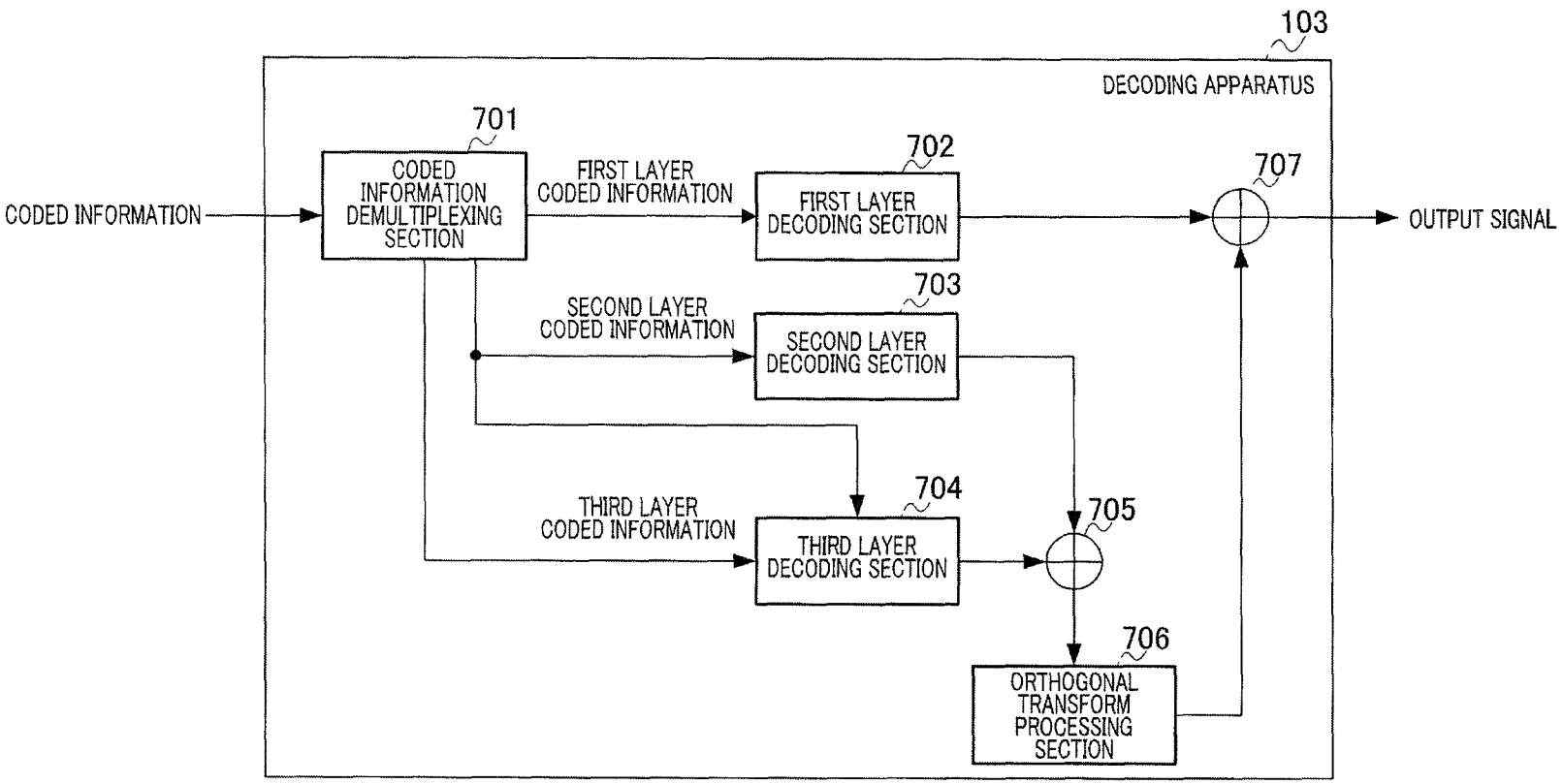
FIG. 7 is a block diagram illustrating a main configuration of the decoding apparatus in FIG. 1.

FIG. 7 is a block diagram illustrating a main configuration of decoding apparatus 103 in FIG. 1. For example, it is assumed that decoding apparatus 103 is a hierarchical decoding apparatus including three decoding hierarchies (layers). At this point, similarly to coding apparatus 101, it is assumed that the three layers are referred to as a first layer, a second layer, and a third layer in the ascending order of the bit rate.

The coded information transmitted from coding apparatus 101 through transmission line 102 is input to coded information demultiplexing section 701, and coded information demultiplexing section 701 demultiplexes the coded information into the pieces of coded information of the layers to output each piece of coded information to the decoding section that performs the decoding processing of each piece of coded information. Specifically, coded information demultiplexing section 701 outputs the first layer coded information included in the coded information to first layer decoding section 702, outputs the second layer coded information included in the coded information to second layer decoding section 703 and third layer decoding section 704, and outputs the third layer coded information included in the coded information to third layer decoding section 704.

First layer decoding section 702 decodes the first layer coded information, which is input from coded information demultiplexing section 701, by the CELP speech decoding method to generate the first layer decoded signal, and outputs the generated first layer decoded signal to adder 707.

Second layer decoding section 703 decodes the second layer coded information input from coded information demultiplexing section 701, and outputs the obtained second layer decoded spectrum X2"(k) to adder 705. Since the processing of second layer decoding section 703 is identical to that of second layer decoding section 206, the description is omitted.

Third layer decoding section 704 decodes the third layer coded information input from coded information demultiplexing section 701, and outputs the obtained third layer decoded spectrum X3"(k) to adder 705. The processing of third layer decoding section 704 will be described later.

The second layer decoded spectrum X2"(k) is input to adder 705 from second layer decoding section 703. The third layer decoded spectrum X3"(k) is input to adder 705 from third layer decoding section 704. Adder 705 adds the input second layer decoded spectrum X2"(k) and third layer decoded spectrum X3"(k), and outputs the added spectrum as a first addition spectrum X4"(k) to orthogonal transform processing section 706.

Orthogonal transform processing section 706 initializes built-in buffer buf'(k) to an initial value "0" by the following equation (15).

[15]

$$buf'(k)=0(k=0,\ldots,N-1) \quad \text{(Equation 15)}$$

The first addition spectrum X4"(k) is input to orthogonal transform processing section 706, and orthogonal transform processing section 706 obtains a first addition decoded signal y"(n) according to the following equation (16).

(Equation 16)

$$y''(n)=\frac{2}{N}\sum_{n=0}^{2N-1}X5(k)\cos\left[\frac{(2n+1+N)(2k+1)\pi}{4N}\right] \quad [16]$$

$$(n-0,\ldots,N-1)$$

In the equation (16), X5($k$) is a vector in which the first addition spectrum X4"(k) and buffer buf'(k) are coupled, and X5($k$) is obtained using the following equation (17).

(Equation 17)

$$X5(k)=\begin{cases} buf'(k) & (k=0,\ldots,N-1) \\ X4''(k) & (k=N,\ldots,2N-1) \end{cases} \quad [17]$$

Then orthogonal transform processing section 706 updates buffer buf'(k) according to the following equation (18).

[18]

$$buf'(k)=X''4(k)(k=0,\ldots,N-1) \quad \text{(Equation 18)}$$

Orthogonal transform processing section 706 outputs the first addition decoded signal y"(n) to adder 707.

The first layer decoded signal is input to adder 707 from first layer decoding section 702. The first addition decoded signal is input to adder 707 from orthogonal transform processing section 706. Adder 707 adds the input first layer decoded signal and first addition decoded signal, and outputs the added signal as the output signal.

Figure 8:
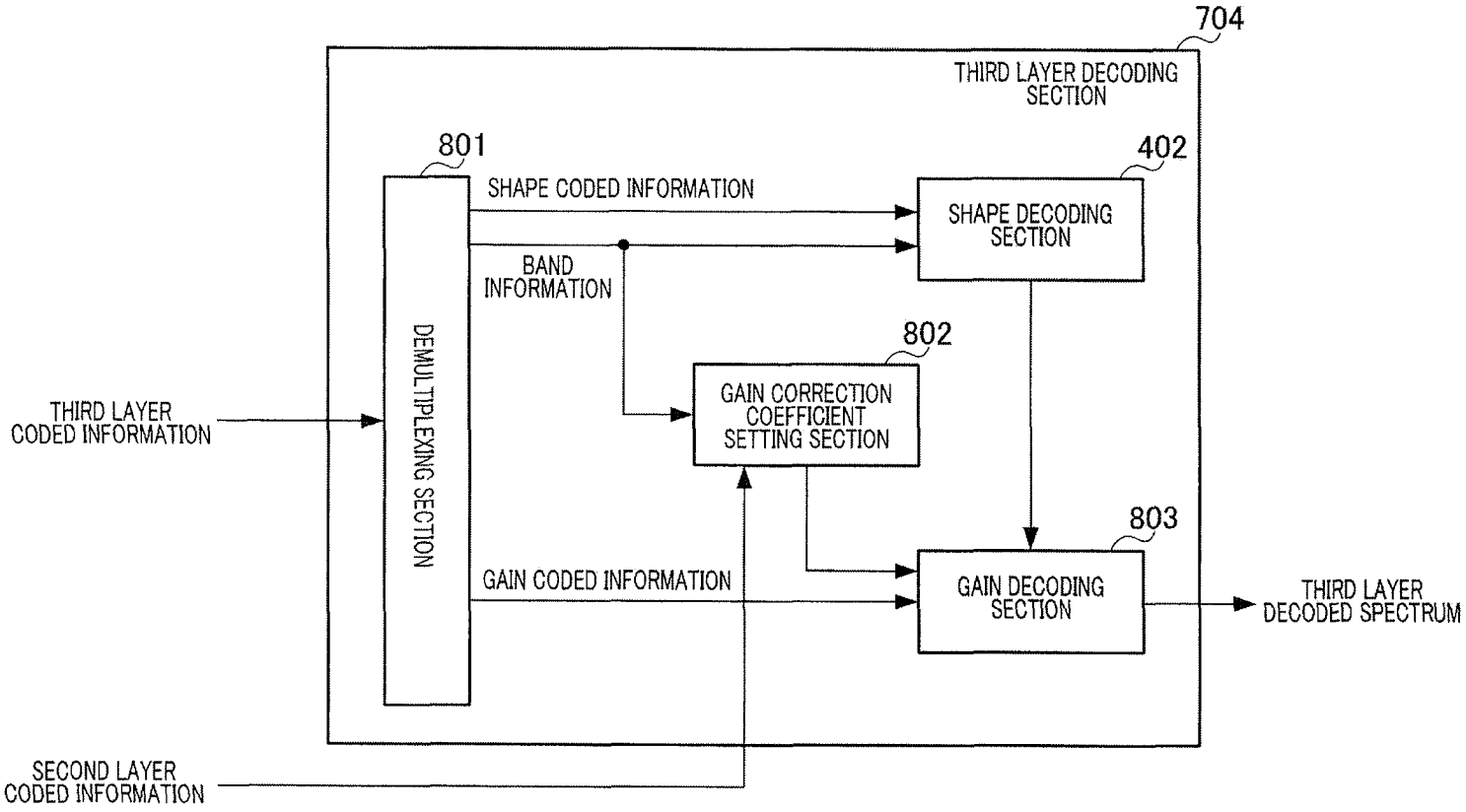
FIG. 8 is a block diagram illustrating a main configuration of a third layer decoding section in FIG. 7.

FIG. 8 is a block diagram illustrating a main configuration of third layer decoding section 704.

In FIG. 8, third layer decoding section 704 includes demultiplexing section 801, shape decoding section 402, gain correction coefficient setting section 802, and gain decoding section 803. Since the structural element constituting shape decoding section 402 is identical to the above structural element, the structural element is designated by the identical numeral, and the description is omitted.

Demultiplexing section 801 demultiplexes the band information, the shape coded information, and the gain coded information from the third layer coded information input from coded information demultiplexing section 701, outputs the obtained band information to shape decoding section 402 and gain correction coefficient setting section 802, outputs the obtained shape coded information to shape decoding section 402, and outputs the obtained gain coded information to gain decoding section 803.

The band information is input to gain correction coefficient setting section 802 from demultiplexing section 801. The band information is the third layer band information that is selected as the coding target by third layer coding section 208.

The second layer coded information is input to gain correction coefficient setting section 802 from coded information demultiplexing section 701. The second layer coded information includes the second layer band information that is selected as the coding target by second layer coding section 205.

Gain correction coefficient setting section 802 sets a correction coefficient that is used to quantize the gain information with respect to the sub-bands indicated by the third layer band information from the second layer band information and the third layer band information.

Specifically, in the case that the sub-band indicated by the second layer band information is not included in the sub-band indicated by the third layer band information (that is, in the case that third layer coding section 704 encodes the band that is not selected as the decoding target by second layer coding section 703), the gain correction coefficient $\gamma_j$ is set as expressed by the equation (11).

In the case that the sub-band indicated by the second layer band information is included in the sub-band indicated by the third layer band information (that is, in the case that third layer coding section 704 re-encodes the band that is not selected as the decoding target by second layer coding section 703), the gain correction coefficient $\gamma_j$ is set as expressed by the equation (12).

Gain correction coefficient setting section 802 outputs the set gain correction coefficient $\gamma_j$ to gain decoding section 803.

Gain decoding section 803 obtains the gain value by performing the dequantization to the gain coded information input from demultiplexing section 801 using the built-in gain code book. Specifically, gain decoding section 803 is provided with the same gain code book as that of gain coding section 602 of third layer coding section 208. Gain decoding section 803 performs the dequantization of the gain by utilizing the gain correction coefficient $\gamma_j$ according to the following equation (19) to obtain the gain value Gain_q'. At this point, gain decoding section 803 deals with the L sub-bands in one region as the L-dimensional vector to perform the vector dequantization.

(Equation 19)

$$\text{Gain_}q'(j+j'')=GC_j^{G-min}\cdot\gamma_j(j=0,\ldots,L-1) \quad [19]$$

Then, gain decoding section 803 calculates the decoded MDCT coefficient as the third layer decoded spectrum according to the following equation (20) using the gain value obtained by the dequantization of the current frame and the value of the shape input from shape decoding section 402. At this point, the calculated decoded MDCT coefficient is expressed by X3"(k). In the case that k exists in B(j") to B(j"+1)−1 during the dequantization of the MDCT coefficient, the gain value Gain_q'(j) takes a value of Gain_q'(j").

(Equation 20)

$$X3''(k)=\text{Gain_q}'(j)\cdot\text{Shape_q}'(k) \quad [20]$$

$$\begin{pmatrix} k=B(j''),\ldots,B(j''+L)-1 \\ j=j'',\ldots,j''+L-1 \end{pmatrix}$$

Gain decoding section 803 outputs the calculated third layer decoded spectrum X3"(k) to adder 705 according to the equation (20).

The processing of third layer decoding section 704 has been described above.

The processing of decoding apparatus 103 has been described above.

According to the invention, in coding apparatus 101 that performs the hierarchy coding (scalable coding) in which the band (quantization target band) of the coding target is selected in each hierarchy (layer), third layer coding section 208 switches the method of quantizing the gain information (energy information) on the quantization target band in the current layer based on the comparison result of the quantization target band in the lower layer and the quantization target band in the current layer.

In the case that the sub-band indicated by the third layer band information that is of the current layer in third layer coding section 208 includes the sub-band indicated by the second layer band information in the lower layer, gain coding section 602 performs the quantization after performing the correction such that the ideal gain Gain_i(j) is increased. As a result, even if the vector quantization is performed to the plural elements in which energy magnitude differs largely from each other, energy magnitude of the elements of the gain code vector can be smoothed. Therefore, using the same gain code book, the vector quantization can efficiently be performed to the pieces of gain information on the plural sub-bands including the sub-band that is selected and quantized in the lower layer and the sub-band that is not selected and quantized in the lower layer, and thus the quality of the decoded signal can be improved.

In gain correction coefficient setting section of Embodiment, by way of example, $\gamma_j$ is set to 0.5 for the sub-band that is selected in the lower layer, and $\gamma_j$ is set to 1.0 for the sub-band that is not selected in the lower layer. However, the invention can also be applied to other setting values.

The method of setting the gain correction coefficient is not limited to the above setting method, but the gain correction coefficient may be set by statistically calculating the gain correction coefficient using many input samples.

In Embodiment, the ideal gain is divided by the gain correction coefficient to smooth the energy, and the vector quantization is performed to the smoothed value. However, the invention is not limited to this Embodiment. For example, the invention can also be applied to a configuration in which the gain correction coefficient is multiplied by each gain code vector in the searched gain code book. However, in the configuration of Embodiment, since the number of calculation times in which the gain correction coefficient is utilized is decreased compared with the above configuration, the quality can be improved while the calculation amount is not increased too much.

In the method of Embodiment, the gain values of the vectors are equalized by increasing the gain value of the sub-band that is quantized in the lower layer. Alternatively, contrary to the method of Embodiment, the gain values of the vectors may be equalized by decreasing the gain value of the sub-band that is not quantized in the lower layer.

In the configuration of Embodiment, the gain code vector in which the square error is minimized is searched with respect to the value in which the ideal gain is divided by the gain correction coefficient, and the gain value is encoded. Additionally, the invention can also be applied to the case that the square error is calculated based on the magnitude of the gain correction coefficient. A specific method will be described below. For example, in the case that the gain correction coefficient has the value of 0.5, a value divided by the gain correction coefficient becomes double the original gain value. Therefore, the calculation is performed to the corresponding sub-band while the value of the square error is multiplied by 0.5. A distance (error) can be calculated in the distribution before the correction is performed using the gain correction coefficient, and therefore the quality of the decoded signal can be improved.

In Embodiment, the CELP coding method is adopted in the first layer coding section by way of example. The invention is not limited to Embodiment, but the invention can also be applied to the case that the first layer coding section does not exist. The invention can also be applied to a configuration in which the first layer coding section encodes the frequency component similarly to the second layer coding section.

The invention can also be applied to a configuration in which, similarly to the second layer coding section, the first layer coding section does not encodes the whole band, but partially selects and encodes the band that becomes the coding target. In this case, since the first layer coding section does not quantize the frequency components of the whole bands, the configuration in which the method of quantizing the gain component (energy component) is switched similarly to the third layer coding section as explained in Embodiment can be applied to the second layer coding section. In the case that the configuration is applied to the second layer coding section, the same gain correction coefficient may be used in the coding section of each layer, or the different gain correction coefficients may be used in the coding section of the layers.

In each band, the different gain correction coefficient can be set according to the number of times in which the band is selected as the quantization target band in the lower layer. In this case, the gain correction coefficient may also be set by statistically calculating the gain correction coefficient using many input samples.

As to the decoding apparatus, the invention can also be applied to each configuration equivalent to the configuration of the coding apparatus.

In Embodiment, the coding apparatus is configured to include the three coding hierarchies (three layers). The invention is not limited to the three coding hierarchies, but the invention can also be applied to the configuration other than the configuration having the three coding hierarchies.

In Embodiment, the CELP coding/decoding method is adopted in the lowest first layer coding section/decoding section. The invention is not limited to Embodiment, but the invention can also be applied to the case that the layer in which the CELP coding/decoding method is adopted does not exist. For example, the adder that performs the addition and subtraction on the temporal axis in the coding apparatus and the decoding apparatus is eliminated for the configuration including the layers in each of which the frequency transform coding/decoding method is adopted.

In Embodiment, the coding apparatus calculates the difference signal between the first layer decoded signal and the input signal, and performs the orthogonal transform processing to calculate the difference spectrum. However, the invention is not limited to Embodiment. Alternatively, the present invention can also be applied to the configuration that after the orthogonal transform processing may be performed to the input signal and the first layer decoded signal to calculate the input spectrum and the first layer decoded spectrum, the difference spectrum may be calculated.

In Embodiment, the decoding apparatus performs the processing using the coded information transmitted from the coding apparatus of Embodiment. Alternatively, as long as the coded information includes the necessary parameter and data, the processing can be performed with no use of the coded information transmitted from the coding apparatus of Embodiment.

In addition, the present invention is also applicable to cases where this signal processing program is recorded and written on a machine-readable recording medium such as memory, disk, tape, CD, or DVD, achieving behavior and effects similar to those of the present embodiment.

Also, although cases have been described with Embodiment as an example where the present invention is configured by hardware, the present invention can also be realized by software.

Each function block employed in the description of Embodiment may typically be implemented as an LSI constituted by an integrated circuit. These may be implemented individually as single chips, or a single chip may incorporate some or all of them. Here, the term LSI has been used, but the terms IC, system LSI, super LSI, and ultra LSI may also be used according to differences in the degree of integration.

Further, the method of circuit integration is not limited to LSI, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI as a result of the advancement of semiconductor technology or a derivative other technology, it is naturally also possible to carry out function block integration using this technology. Application of biotechnology is also possible.

The present invention contains the disclosures of the specification, the drawings, and the abstract of Japanese Patent Application No. 2009-237684 filed on Oct. 14, 2009, the entire contents of which being incorporated herein by reference.

INDUSTRIAL APPLICABILITY

The coding apparatus, decoding apparatus, and methods thereof according to the present invention can improve the quality of the decoded signal in the configuration in which the coding target band is selected in the hierarchical manner to perform the coding/decoding. For example, the coding apparatus, decoding apparatus, and methods thereof according to the present can be applied to the packet communication system and the mobile communication system.

REFERENCE SIGNS LIST

101 Coding apparatus
102 Transmission line
103 Decoding apparatus
201 First layer coding section
202,702 First layer decoding section
203,207,705,707 Adder
204, 706 Orthogonal transform processing section
205 Second layer coding section
206,703 Second layer decoding section
208 Third layer coding section
209 Coded information integration section
301 Band selecting section
302 Shape coding section
303,602 Gain coding section
304 Multiplexing section
401,801 Demultiplexing section
402 Shape decoding section
403,803 Gain decoding section
601,802 Gain correction coefficient setting section
701 Coded information demultiplexing section
704 Third layer decoding section

The invention claimed is:

1. A coding apparatus that includes at least two coding layers in scalable coding, the coding apparatus comprising:

a first layer encoder that receives a first input signal, that is a speech/audio signal, of a frequency domain, selects a first quantization target band of the first input signal from a plurality of sub-bands into which the frequency domain is divided, encodes the first input signal of the first quantization target band to generate first coded information including first band information on the first quantization target band, generates a first decoded signal using the first coded information, and generates a second input signal, that is a speech/audio signal, using the first input signal and the first decoded signal;

a second layer encoder that receives the second input signal and the first coded information, obtains second band information by selecting a second quantization target band of the second input signal from the plurality of sub-bands, obtains a gain of the second input signal of the second quantization target band, encodes the second input signal of the second quantization target band using the first coded information, and generates second coded information including the second band information and gain coded information obtained by coding the gain; and a coded information integrator that integrates and transmits the first coded information and the second coded information, wherein the second layer encoder switches a gain correction coefficient used to correct the gain between when the first quantization target band is not included in the second quantization target band and when the first quantization target band is included in the second quantization target band, wherein at least one of the first layer encoder, the second layer encoder, and the coded information integrator is implemented by a tangible processor.

2. The coding apparatus according to claim 1, wherein the second layer encoder includes:

a band selector that selects the second quantization target band of the second input signal from the plurality of sub-bands to generate the second band information, and outputs the second input signal of the second quantization target band; and a shape/gain encoder that encodes a shape and the gain of the second input signal of the second quantization target band to generate shape coded information and the gain coded information.

3. The coding apparatus according to claim 2, wherein the second layer encoder further includes a coefficient setter that sets the gain correction coefficient, the gain correction coefficient correcting a magnitude of a code vector of the first coding quantization band in code vectors, which are stored in a code book used to encode the gain, using the first coded information, and the shape/gain encoder encodes the gain using the code book, in which the code vector of the first quantization target band is corrected, using the gain correction coefficient.

4. The coding apparatus according to claim 3, wherein the coefficient setter sets the gain correction coefficient such that a distribution of the magnitude of the code vector of the second quantization target band in the code book is brought close to a distribution of magnitude of the gain of the second quantization target band.

5. The coding apparatus according to claim 2, wherein the second layer encoder further includes a selector that selects a method of quantizing the gain using a comparison result of the first quantization target band obtained using the first band information included in the first coded information and the second quantization target band obtained using the second band information, and the shape/gain encoder encodes the gain using the quantization method selected by the selector.

6. A communication terminal apparatus comprising the coding apparatus according to claim 1.

7. A base station apparatus comprising the coding apparatus according to claim 1.

8. A decoding apparatus that receives and decodes information generated by a coding apparatus including at least two coding layers in scalable coding, the decoding apparatus comprising:

a receiver that receives the information including first coded information and second coded information, the first coded information being obtained by coding a first layer of the coding apparatus, the first coded information including first band information generated by selecting a first quantization target band of the first layer from a plurality of subbands into which a frequency domain is divided, the second coded information being obtained by coding a second layer of the coding apparatus using the first coded information, the second coded information including second band information generated by selecting a second quantization target band of the second layer from the plurality of sub-bands;

a first layer decoder that receives the first coded information obtained from the information, and generates a first decoded signal with respect to the first quantization target band set based on the first band information included in the first coded information;

a second layer decoder that receives the first coded information and the second coded information, which are obtained from the information, and generates a second decoded signal, that is a speech/audio signal, by correcting a signal for the second quantization target band, which is set based on the second band information included in the second coded information, using the first coded information and the second coded information; and an adder that adds the first decoded signal and the second decoded signal, and outputs the added signal as an output signal that is a speech/audio signal, wherein the second layer decoder switches a gain correction coefficient used to correct a gain of the second decoded signal between when the first quantization target band is not included in the second quantization target band and when the first quantization target band is included in the second quantization target band, wherein at least one of the first layer decoder, the second layer decoder and the adder is implemented by a tangible processor.

9. The decoding apparatus according to claim 8, wherein the first layer decoder includes:

a first shape decoder that obtains a shape of the first decoded signal with respect to the first quantization target band using the first shape coded information and the first band information which are included in the first coded information; and a first gain decoder that obtains a gain of the first decoded signal using first gain coded information included in the first coded information, and generates the first decoded signal using the shape of the first decoded signal with respect to the first quantization target band and the gain of the first decoded signal.

10. The decoding apparatus according to claim 8, wherein the second layer decoder includes:

a second shape decoder that obtains a shape of the second decoded signal with respect to the second quantization target band using the second shape coded information and the second band information which are included in the second coded information; and a second gain decoder that obtains the gain of the second decoded signal using second gain coded information included in the second coded information, generates a correction gain of the second decoded signal, in which the gain of the second decoded signal is corrected, using the first band information included in the first coded information and the second band information included in the second coded information, and generates the second decoded signal using the shape of the second decoded signal with respect to the second quantization target band and the correction gain of the second decoded signal.

11. A communication terminal apparatus comprising the decoding apparatus according to claim 8.

12. A base station apparatus comprising the decoding apparatus according to claim 8.

13. A coding method of performing coding in at least two coding layers in scalable coding, comprising:

performing a first layer coding, including: receiving a first input signal, that is a speech/audio signal, of a frequency domain, selecting a first quantization target band of the first input signal from a plurality of sub-bands into which the frequency domain is divided, encoding the first input signal of the first quantization target band to generate first coded information including first band information on the first quantization target band, generating a first decoded signal using the first coded information, and generating a second input signal, that is a speech/audio signal, using the first input signal and the first decoded signal;

performing a second layer coding, including: receiving the second input signal and the first coded information, obtaining second band information by selecting a second quantization target band of the second input signal from the plurality of sub-bands, obtaining a gain of the second input signal of the second quantization target band, encoding the second input signal of the second quantization target band using the first coded information, and generating second coded information including the second band information and gain coded information obtained by coding the gain; and integrating and transmitting the first coded information and the second coded information, wherein the second layer coding switches a gain correction coefficient used to correct the gain between when the first quantization target band is not included in the second quantization target band and when the first quantization target band is included in the second quantization target band, wherein at least one of the performing of the first layer coding, the performing of the second layer coding, the integrating and the transmitting is performed by a tangible processor.

14. A decoding method of receiving and decoding information generated by a coding apparatus including at least two coding layers in scalable coding, comprising:

receiving the information including first coded information and second coded information, the first coded information being obtained by coding a first layer of the coding apparatus, the first coded information including first band information generated by selecting a first quantization target band of the first layer from a plurality of sub-bands into which a frequency domain is divided, the second coded information being obtained by coding a second layer of the coding apparatus using the first coded information, the second coded information including second band information generated by selecting a second quantization target band of the second layer from the plurality of sub-bands;

performing a first layer decoding, including: receiving the first coded information obtained from the information, and generating a first decoded signal, that is a speech/audio signal, with respect to the first quantization target band set based on the first band information included in the first coded information;

performing a second layer decoding, including: receiving the first coded information and the second coded information, which are obtained from the information, and generating a second decoded signal, that is a speech/audio signal, by correcting a signal for the second quantization target band, which is set based on the second band information included in the second coded information, using the first coded information and the second coded information; and adding the first decoded signal and the second decoded signal, and outputting the added signal as an output signal, that is a speech/audio signal, wherein the second layer decoding switches a gain correction coefficient used to correct a gain of the second decoded signal between when the first quantization target band is not included in the second quantization target band and when the first quantization target band is included in the second quantization target band, wherein at least one of the performing of the first layer decoding, the performing of the second layer decoding, the adding and the outputting is performed by a tangible processor.

* * * * *